US010772781B2

(12) United States Patent
Leheurteux

(10) Patent No.: US 10,772,781 B2
(45) Date of Patent: Sep. 15, 2020

(54) EXPANDABLE BODY BAG

(71) Applicant: SOLUTIONS VETCETERRA, Ormstown (CA)

(72) Inventor: Celine Leheurteux, Hemmingford (CA)

(73) Assignee: SOLUTIONS VETCETERRA (CA)

( * ) Notice: Subject to any disclaimer, the term of this patent is extended or adjusted under 35 U.S.C. 154(b) by 0 days.

(21) Appl. No.: 15/730,804

(22) Filed: Oct. 12, 2017

(65) Prior Publication Data

US 2018/0104127 A1 Apr. 19, 2018

Related U.S. Application Data

(60) Provisional application No. 62/407,803, filed on Oct. 13, 2016.

(30) Foreign Application Priority Data

Oct. 13, 2016 (CA) ..... 2945229

(51) Int. Cl.
*A61G 17/06* (2006.01)
*A61G 17/007* (2006.01)

(52) U.S. Cl.
CPC ..... *A61G 17/06* (2013.01); *A61G 17/0136* (2017.05)

(58) Field of Classification Search
CPC .. A61G 17/06; A61G 17/0136; A61G 17/007; B65D 31/10
USPC ..... 27/28; 383/120
See application file for complete search history.

(56) References Cited

U.S. PATENT DOCUMENTS

| | | | |
|---|---|---|---|
| 4,780,940 | A | 11/1988 | Jay |
| 4,790,040 | A | 12/1988 | Grilliot et al. |
| 4,790,051 | A | 12/1988 | Knight |
| 4,992,562 | A | 2/1991 | Kleinman et al. |
| 5,341,548 | A | 8/1994 | Zerick |
| 5,715,583 | A | 2/1998 | Sandoval |
| 6,004,034 | A | 12/1999 | Salam |
| 6,052,877 | A | 4/2000 | Richard |
| 6,574,840 | B1 | 6/2003 | Doppel |
| 6,694,579 | B2 | 2/2004 | Belanger et al. |
| 7,228,603 | B2 | 6/2007 | Craig |
| 7,337,511 | B2 | 3/2008 | Yu et al. |
| 8,453,303 | B1 | 6/2013 | Gamertsfelder et al. |
| 9,056,040 | B2 | 6/2015 | Gesell et al. |

(Continued)

FOREIGN PATENT DOCUMENTS

| | | | |
|---|---|---|---|
| EP | 2340801 | B1 | 3/2014 |
| JP | 2008194081 | A | 8/2008 |

*Primary Examiner* — William L Miller

(57) ABSTRACT

Users of body bags know and live with the technical issues that come with the reality of the manipulation of the corpse of a deceased animal or human. The simple and efficient design of this body bag is free of unnecessary structures, is expandable to adapt to various body shapes depending on species and size through two expandable gussets, is leak proof through glued side folds, presents an aperture that allows access to the entire corpse through a closable flap, is permanently identifiable through a printed identification area, is the only bag necessary for transportation, storing and disposal and is compact, sturdy, and economical. With this invention, technical issues are addressed while bringing an even more dignified look to the corpse of the deceased in the body bag for the family, the public and the professionals involved in the process.

18 Claims, 27 Drawing Sheets

(56) References Cited

U.S. PATENT DOCUMENTS

| | | | | |
|---|---|---|---|---|
| 2010/0263178 | A1 | 10/2010 | Jensen et al. | |
| 2014/0259577 | A1* | 9/2014 | Richardson | A61G 17/06 27/28 |
| 2016/0101009 | A1* | 4/2016 | Newell | A61G 17/06 27/28 |
| 2016/0176622 | A1* | 6/2016 | Vertsteylen | A61G 17/047 206/205 |
| 2018/0333319 | A1* | 11/2018 | Venosi | A61G 17/06 |

* cited by examiner

FIG. 13

FIG. 14

FIG. 15

FIG. 16

FIG. 22

FIG. 23

FIG. 31

FIG. 32

EXPANDABLE BODY BAG

FIELD OF THE INVENTION

The present invention belongs to the field of holding and carrying an animal or a human body after death in a practical way for users while preserving the dignity of deceased individuals.

BACKGROUND

Body bags are a necessity for transporting the corpse of animals or humans after death. The models available do not adapt to the various body shapes nor do they always ensure the prevention of leakage of body fluids. Identification of the body is often dependant on an accessory that can be lost, missing or interchanged. No simple and economical options are available on the market. The materials used presently do not reflect the sacred aspect of death nor are they appropriate for public view.

It is disclosed in U.S. Pat. Nos. 6,694,579 and 9,056,040 variations of cardboard containers for humans. Such solutions are not appropriate for veterinarians because of the limited storage space available and the time consuming steps of assembling such containers. For animals, it is disclosed in U.S. Pat. Nos. 6,574,840, 8,453,303, 6,052,877, and 5,341,548 variations of burial containers, vaults or cases.

Such solutions are not adapted to the reality of veterinarians since they are meant for either transportation or burial by the pet's owner. Furthermore, such solutions are made of rigid material that cannot be adapted to the animal's size nor to the reality of storing various corpse sizes in a standard veterinary clinic freezer.

Health care professionals in animal clinics, hospitals, or morgues need a simple economical body bag, similar to those disclosed in US 2010/0263178 and EP 2,340,801 B2. However, the bag disclosed in the latter is not meant for animals and the numerous stitches and pieces of fabric used to manufacture the bag reduce its leak proof aspect. Furthermore, the bag disclosed in EP 2,340,801 B2 is equipped with a specific forensic system not required for use with animals, thus increasing cost. The bag disclosed in US 2010/0263178 does not have an expandable means thus limiting its use with various species and body shapes and presents gripping devices and an absorbent body that are not mandatory for use in animals.

Body bags are also disclosed in U.S. Pat. Nos. 6,004,034, 4,992,562, 7,228,603, 7,337,511, 4,790,040, 4,780,940, 4,790,051, and 5,715,583, as well as JP 2008194081. However, the disclosed bags all present one or a combination of the following disadvantages rendering them not suitable for veterinarians:

Absence of gusset, thus not expandable;

Not made for animals;

Present unnecessary structures and multiple layers;

Not made of a material suitable for cremation;

Not compact; and

Not cost efficient.

The absence of a gusset, combined with the material used most commonly for body bags, allows the different parts of the corpse in the body bag to be distinguished, then not providing optimal respect of the dignity of the deceased.

Further to the visual aspect, veterinarians or other health care professionals need a solution to store corpses of numerous shapes and sizes of dead individuals in a safe and clean manner before safe disposal, preferably most commonly via incineration or burial.

This invention has the objective to solve technical issues while improving the image of the body bag and respect for the dignity of the deceased.

SUMMARY OF THE INVENTION

According to one aspect of the present invention, an object is to provide a body bag for containing a body, the body bag comprising:

a main containment body having top and bottom panels, the top panel including a closable flap being positioned, shaped and sized for allowing an insertion of the body into the main containment body of the body bag via said closable flap; and at least one expandable gusset operatively extendable between the top and bottom panels so as to allow the body bag to vary in size in accordance with the body being inserted into the main containment body.

According to one aspect of the present invention, an object is to provide a body bag for containing a body of a dead animal, the body bag comprising:

a main containment body having top and bottom panels;

a pair of first and second expandable gussets extending along opposite longitudinal sides of the main containment body, each expandable gusset including at least one additional panel being operatively extendable between the top and bottom panels of the main containment body, so as to allow the body bag to vary in size in accordance with the body of the dead animal being inserted into the main containment body, the panels of the expandable gussets and the panels of the main containment body being connected to one another so as to provide the body bag with a substantially leakproof capability; and a closable flap disposed about the top panel of the main containment body, and being positioned, shaped and sized for allowing an insertion of the body of the dead animal into the main containment body of the body bag via said closable flap on the top panel, the closable flap being further provided with a fastening device configured to selectively open and close the body bag via said closable flap, the fastening device being further configured to render the closable flap substantially leakproof with the main containment body when the fastening device is operated in a closed configuration.

Other possible aspect(s), object(s), embodiment(s), variant(s) and/or advantage(s) of the present invention, all being preferred and/or optional, are briefly summarized hereinbelow.

For example, according to a preferred embodiment, it is disclosed a body bag presenting a leak proof base made of a single foldable piece of waterproof material, the piece of material once folded is sealed first on opposite sides along joint lines while defining two expandable gussets located on the second opposite sides of the body bag for adapting the size of the body bag to the size and/or shape of the corpse, the top panel having a closable aperture to facilitate insertion of the corpse into the bag and a bottom panel forming a leakproof base.

According to a preferred embodiment, it is disclosed a method for the making of a body bag for containing a corpse, the body bag being adaptable in size and shape to the corpse when the corpse is inserted into the bag, the method comprising the steps of:

folding and sealing a single piece of waterproof material to form a tubular piece with opened opposite transversal sides;

sealing the opened opposite transversal sides of the tubular piece with joint lines while forming two expandable gussets along opposite longitudinal sides and obtaining a leak proof base; and forming a closable aperture on the top panel adapted to insert the corpse into the bag.

According to a preferred embodiment, it is further disclosed a method for storing a corpse of an individual, the method comprising the steps of:

inserting the corpse into a body bag having a top panel with a closable aperture and a leak proof bottom panel, the body bag presenting two opposite expandable gussets along opposite longitudinal sides, the size of the body bag adapting by itself to the size of the corpse by expanding the gussets; and closing the aperture of the body bag.

According to a preferred embodiment, the aperture of the body bag is sealed with a shutting device to avoid reopening of the bag after the bag has been sealed.

According to a preferred embodiment, the bag may have a light color printed identification area for permanent identification the body bag regardless of the color of the body bag.

The body bag according to the present disclosure is totally adapted to the technical reality of disposal of an animal or human corpse after death in a practical way for users while preserving the dignity of the deceased individual. The body bag adapts to the countless varieties of body shapes and sizes, while preventing leakage of body fluids. The bag may be easily permanently identifiable and is durable. The body bag is preferably manufactured using a fabric with a certain rigidity as to limit moulding of the corpse. The bag is also preferably made with a tear resistant material for limiting damages caused by animal claws, nails of hoofs that would decrease the leak proof aspect of the bag. All this while concealing the corpse from public view and ensuring respect of the deceased.

Various advantages result from the present body bag system, such as, for example:

Adapting the size of the body bag to various body shapes depending on species and size through expandable gussets and enhancing the aspect of the corpse in the body bag.

Prevention of leakage of body fluids with an upward fold preferably glued replacing the possibly leaking stitching and enhancing the solidity of the body bag.

Optionally allowing permanent identification of the body on the body bag regardless of its color on a printed identification area that cannot be modified or lost, therefore preventing errors.

Providing the body bag with a locking mechanism that prevents opening the body bag once closed.

Providing a respectful and dignified look for the deceased, his family and the public.

Simple and relatively low cost, made from a single piece of fabric thus eliminating fabric and time losses.

Lightweight and foldable as to minimize the space required for storing a large quantity of bags before their use.

Tear resistant fabric and body bag.

Made from materials suited for cremation therefore limiting residues after incineration and toxic emanations.

Only one bag is used for transportation, storage, and cremation.

Serves the purpose of body bag and burial case, and is also suited for cremation.

The disclosed body bag can be made of materials that are preferably water resistant, or plasticized inside and preferably thick enough to mask details of body parts shapes. The shutting device, preferably a Zipper™, can be made from plastic suited for cremation therefore limiting residue after incineration. The aperture of the bag may have different shapes such as linear, or "Y", but is preferably semi-circular or "D"-shaped for facilitating insertion of the dead individual into the bag. Additionally, the body bag is preferably made from a fabric having memory feature to facilitate expansion of the gussets and to allow them to stay in the expanded position once the individual has been inserted.

The body bag may be manufactured in numerous sizes specific to the type of animals such as farm, wild and domestic animals and different human life stages.

BRIEF DESCRIPTION OF THE DRAWINGS

The above and other objects, features and advantages of the invention will become more readily apparent from the following description, reference being made to the accompanying drawings in which:

FIG. 13 is a front elevational view of what is shown in FIG. 10.

FIG. 14 is a rear elevational view of what is shown in FIG. 10.

FIG. 15 is a right-side elevational view of what is shown in FIG. 10.

FIG. 16 is a left-side elevational view of what is shown in FIG. 10.

FIG. 22 is a front elevational view of what is shown in FIG. 19.

FIG. 23 is a rear elevational view of what is shown in FIG. 19.

FIG. 31 is a front elevational view of what is shown in FIG. 28.

FIG. 32 is a rear elevational view of what is shown in FIG. 28.

DETAILED DESCRIPTION OF PREFERRED EMBODIMENTS

Figure 1:
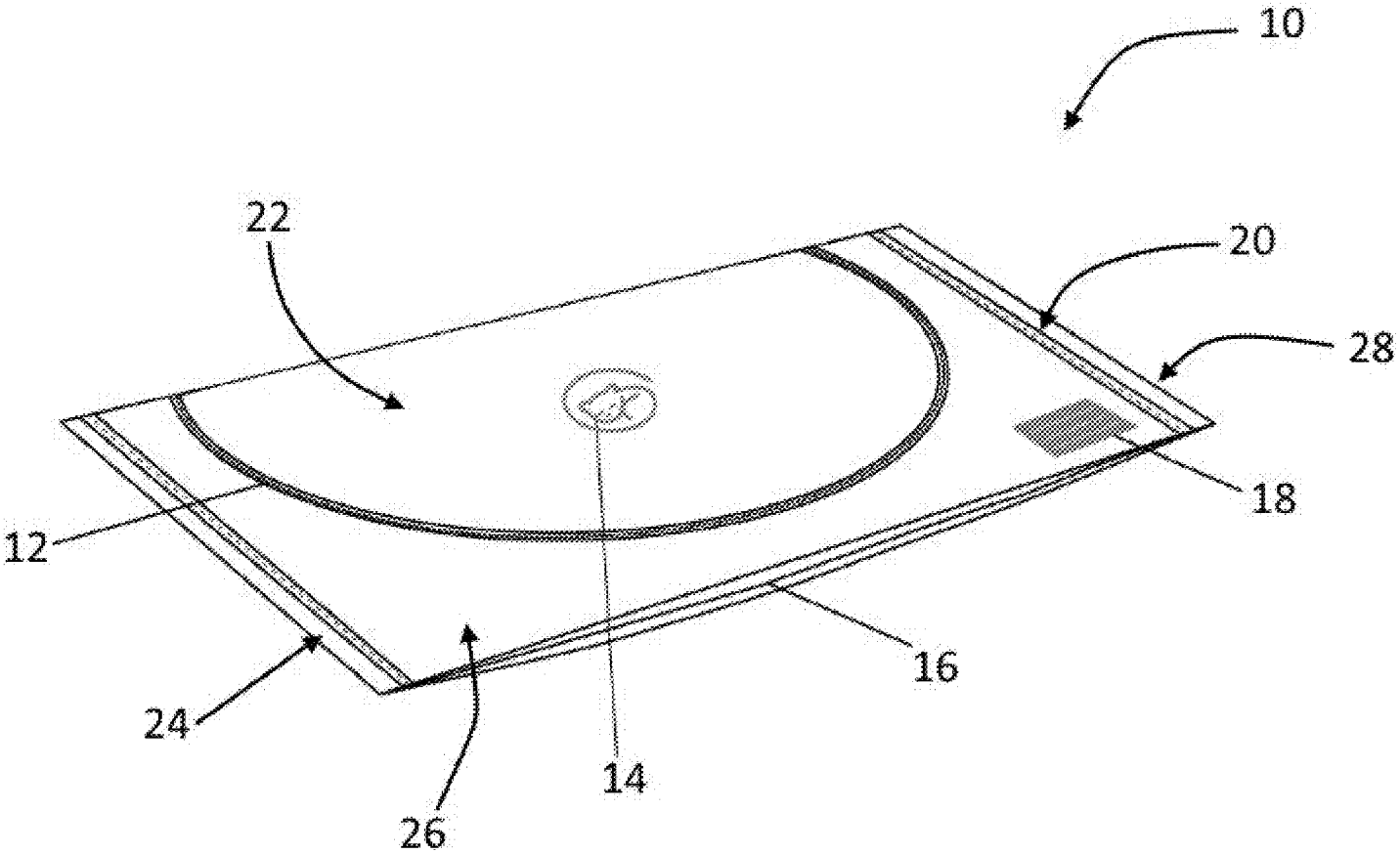
FIG. 1 illustrates a perspective view of a body bag in accordance with the principles of the present invention.

A novel expandable body bag with leakproof base will be described hereinafter. Although the invention is described in terms of specific illustrative embodiment(s), it is to be understood that the embodiment(s) described herein are by way of example only and that the scope of the invention is not intended to be limited thereby.

According to a preferred embodiment, it is disclosed a body bag presenting a leak proof base made of a single folded piece of waterproof material.

According to a preferred embodiment, the piece of material once folded is sealed on first opposite sides along joint lines while defining two expandable gussets located on second opposite sides of the body bag for adapting the size of the body bag to a size and/or shape of the corpse when the corpse is inserted into the bag, the joint lines are then folded and glued on the top panel having a closable aperture for inserting the corpse into the bag to form an hermetic chamber when the aperture is sealed.

According to a preferred embodiment, the disclosed body bag provides a side fold that is sealed upward, preferably with glue, and that limits leakage of biological fluids and contributes with the gusset to the expandable aspect of the body bag.

According to a preferred embodiment, the body bag of the present disclosure preferably presents a light color printed area allowing identification on any body bag regardless of its color and prevention of identification falsifications.

According to a preferred embodiment, the body bag of the present disclosure has a closable aperture or flap that is connected to the bottom flap upward in one line that is preferably stitched. The bottom flap is unique in that it is preferably made with only one piece of preferably waterproof fabric. This enhances prevention of leakage from the body bag.

The body bag of the present disclosure has a shutting device, a Zipper™ installed in the closable flap that can be leak proof or not. This leak proof feature of the shutting device is not necessary with normal manipulations but it could be added for complete leakage control.

Also disclosed are the various sizes of body bags according to the species they are designed for such as, but not limited to, cats, dogs, ferrets, rodents, lagomorphs, primates, farm, exotic and wildlife animals and different life stages of humans.

According to a preferred embodiment, it is disclosed a body bag comprising a top panel having a closable aperture for inserting a corpse into the bag, the top panel being connected to a bottom panel to form an hermetic chamber when the aperture is sealed, the bag defining at least two expandable gussets located on opposite sides of said panels for adapting the body bag to a size of the dead individual once inserted into the bag.

According to a preferred embodiment, the bag is preferably cut from a sole piece of material folded in a substantially rectangular shape to define the top and bottom panel. The flap may be cut from the main piece of fabric for facilitating sewing.

Still according to a preferred embodiment, the short sides joint lines of the body bag described herein above are preferably glued and preferably located on the top panel of the body bag for limiting leakage of body fluids.

Further according to a preferred embodiment, a printed area is located on the top panel of the body bag described herein above for permanent identification of the contained individual.

Further according to a preferred embodiment, the material used can be non-woven polypropylene, polyester, polyethylene, partially made from recycled material, water resistant, coated or plasticized inside with polyethylene.

Further according to a preferred embodiment, the shutting device may comprise a locking mechanism to avoid opening the bag once closed with the dead individual inside.

FIG. 1 illustrates an overall look of the body bag 10 with his gusset 16, the leak proof side fold 28, the optional identification printed area 18, the closable flap 22 having preferably a semi-circular or "D"-shape, a shutting device 12, preferably a Zipper™. Accessorily, a logo 14 may be printed on the body bag 10. The optional printed area may be used to identify the contained individual.

Still referring to FIG. 1, a portion of the bottom panel 24 reaches the top of the body bag 10 via a fold 28. The bottom panel 24 is then connected to the top panel 26 via a joint line 20. The fold occurs on top of the body bag 10 as to limit fluid leakage. The joint line 20 is preferably glued on top of the body bag 10 also as to limit fluid leakage.

Figure 2:
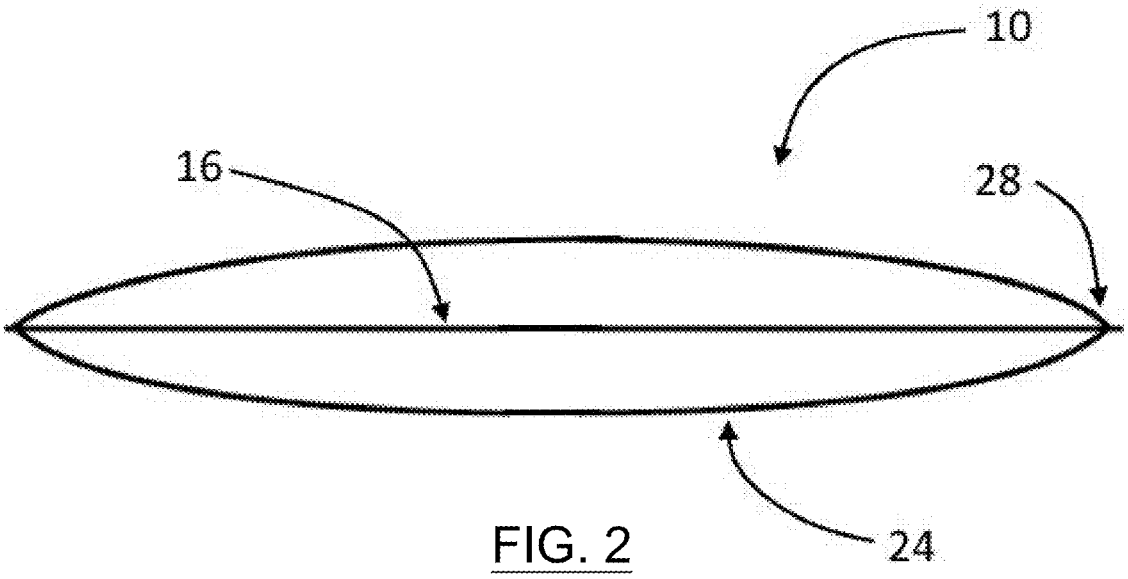
FIG. 2 illustrates a side view of the gusset of a body bag in accordance with the principles of the present invention.

FIG. 2 illustrates a side view of the body bag 10 illustrating the gusset 16 being part of the bottom panel 24 forming the body bag compartment preferably in only one piece of material, preferably waterproof fabric, therefore contributing to the leak proof aspect of the body bag along with the side fold 28.

Figure 3:
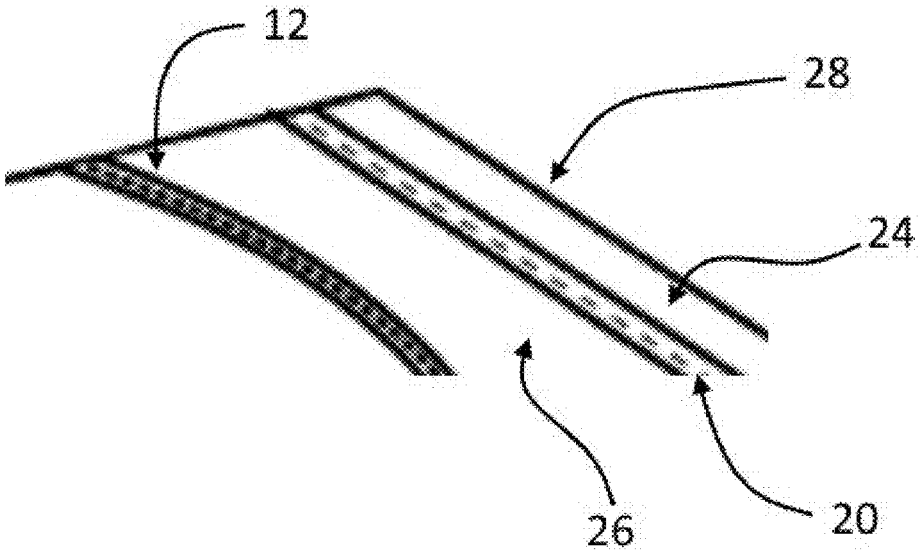
FIG. 3 illustrates a plan view of the leak proof fold of a body bag in accordance with the principles of the present invention.

Now referring to FIG. 3, the bottom panel 24 is folded upwardly via a fold line 28 in order to reach the top of the body bag 10 and to be connected to the top panel 26 via the joint line 20. The joint line is preferably glued to the top panel 26 as to further enhance the leak proof aspect of the body bag by limiting the downward leaks that would occur if the material was stitched instead. The side fold 28 also contributes to the expandable feature and solidity of the body bag.

Figure 4:
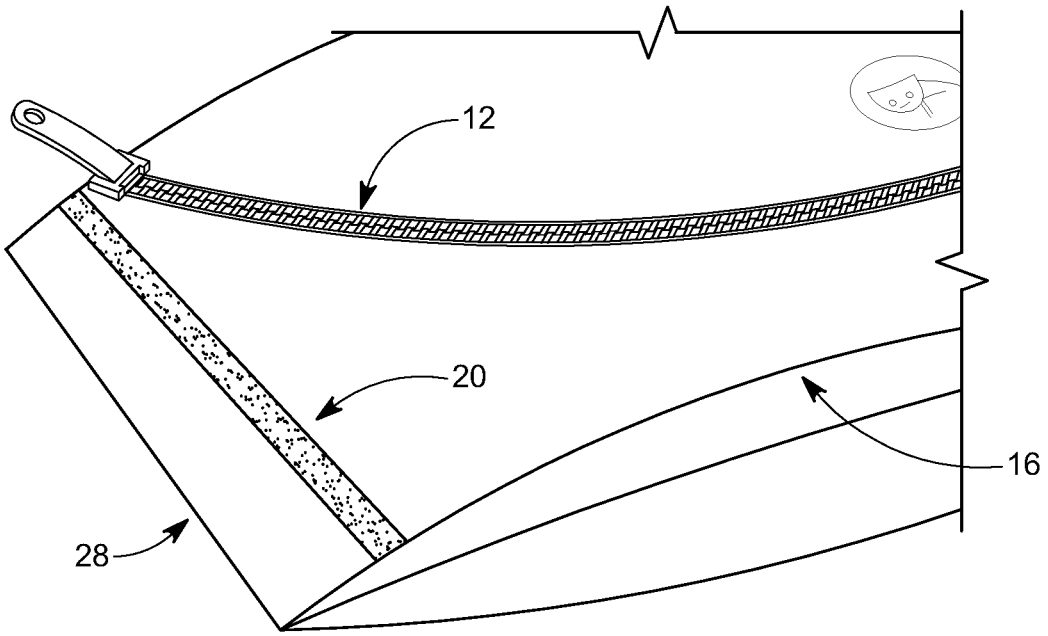
FIG. 4 is a picture of the leak proof fold of a body bag in accordance with the principles of the present invention.

FIG. 4 is a picture showing the side fold 28 connected to the top panel 26 via the joint line 20, and the expandable gusset 16.

Now referring to FIGS. 1 to 4, the flap 22 is open and the corpse is inserted inside the body bag 10. The gusset 16 is used to adapt the size of the body bag 10 to the size of the dead individual. Once inserted, the flap 22 is closed using the shutting device 12.

The body bag may be manufactured in various dimensions or sizes according to the different species and size of animals and different human life stages.

Figure 5:
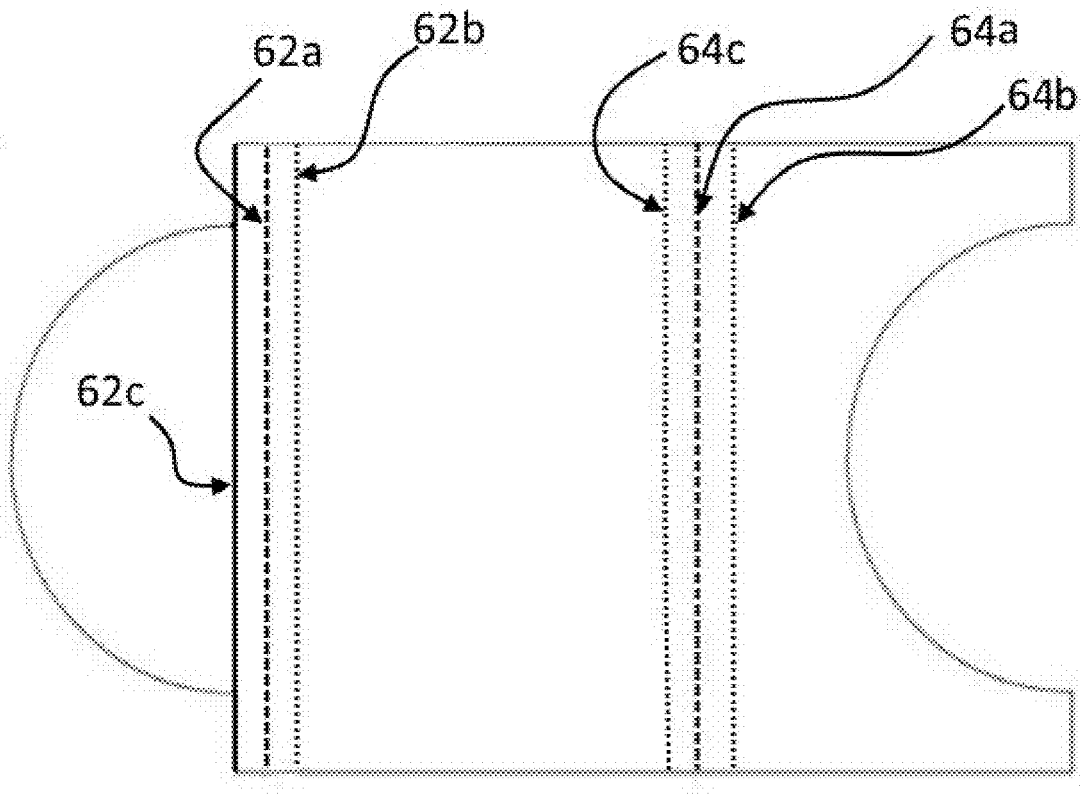
FIG. 5 is a top view of the unassembled body bag.
Figure 6:
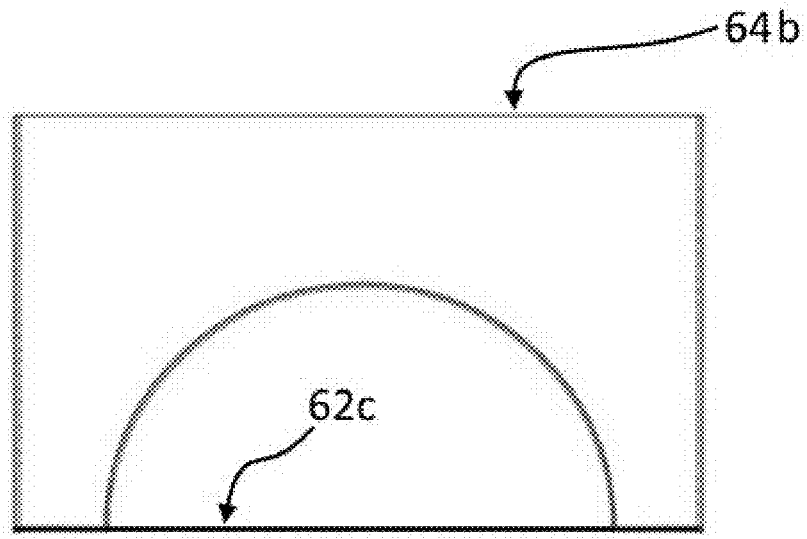
FIG. 6 is a top view of the assembled body bag.

Referring to FIGS. 5 and 6 representing top views of the unassembled and assembled body bag, respectively. The body bag is preferably made with a sole piece of material and is folded following lines 62 and 64. The body bag may be made from two pieces of material separated by the line 62*c*. The assembled body bag is illustrated on FIG. 6.

Figure 7:
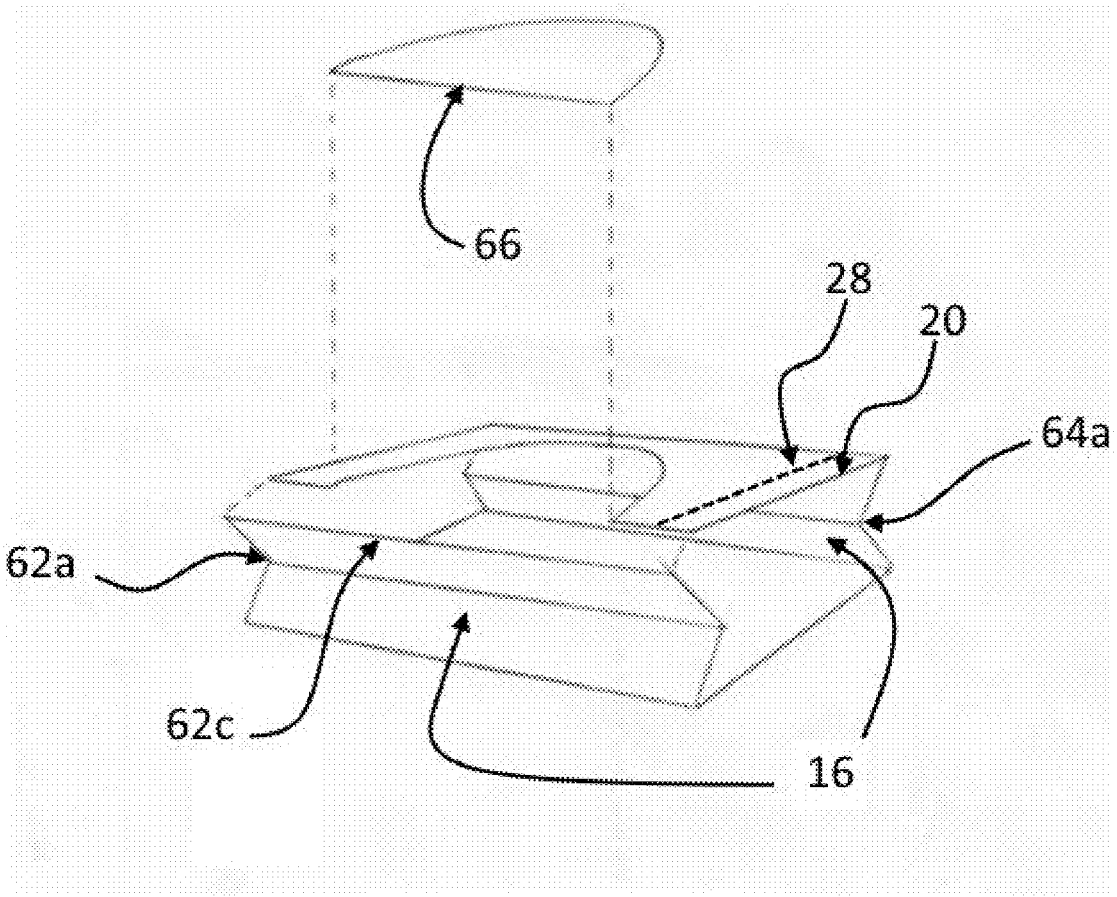
FIG. 7 is a perspective view of the body bag illustrating the assembly.

Now referring to FIG. 7, the perspective view of the bag shows how the two pieces of materials are folded in order to create the gussets 16. A gusset is formed by creating two supplemental folds on each side close to lines 62*a* and 64*a*. Once folded, the closable flap is connected to the main piece of material following lines 66 and 62*c*.

Now referring to FIGS. 5 and 7, the gussets 16 are created by a succession of creases 64*a*, 64*b*, 64*c* on one side and 62*a*, 62*b*, 62*c* on the other side. When folded, crease line 64*b*/62*b* lays flat on crease line 64*c*/62*c*. Crease lines 64*a* and 62*a* are folded inward as illustrated in FIG. 7.

Now referring to FIGS. 1, 4, and 7, the non-gusset sides are folded over line 28 to close the body bag and connected to the top panel, preferably with glue, over line 20.

Figure 8:
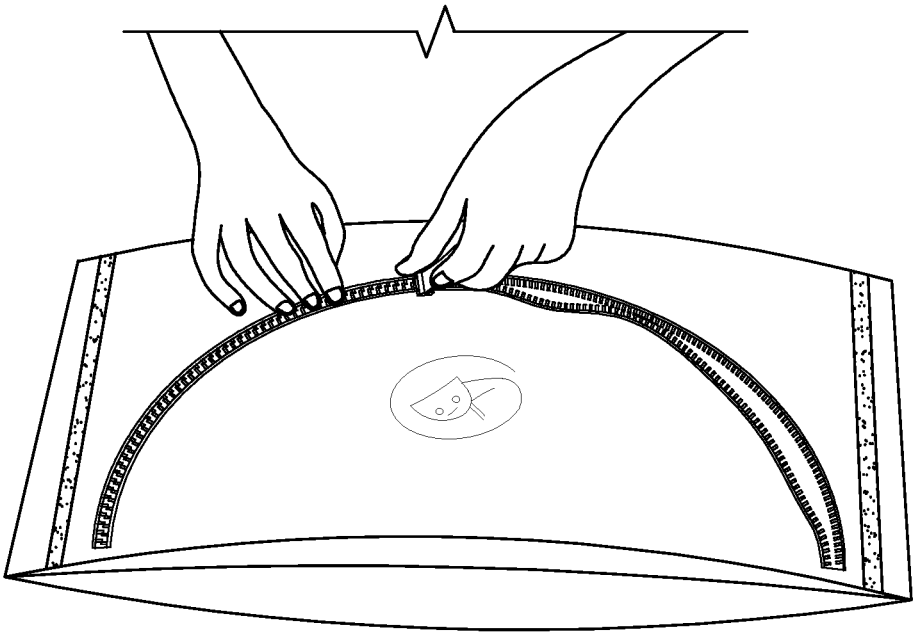
FIG. 8 is a picture of the body bag while in use.

Once the deceased individual has been inserted into the body bag, the flap is then sealed using the shutting device as illustrated on FIG. 8.

Figure 9:
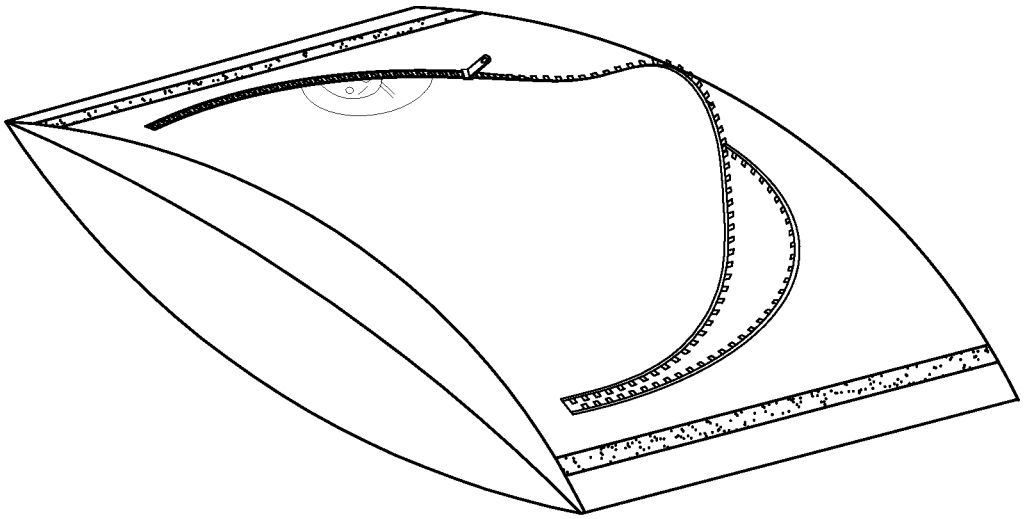
FIG. 9 is a picture of the body bag containing an example of a dead animal.
Figure 10:
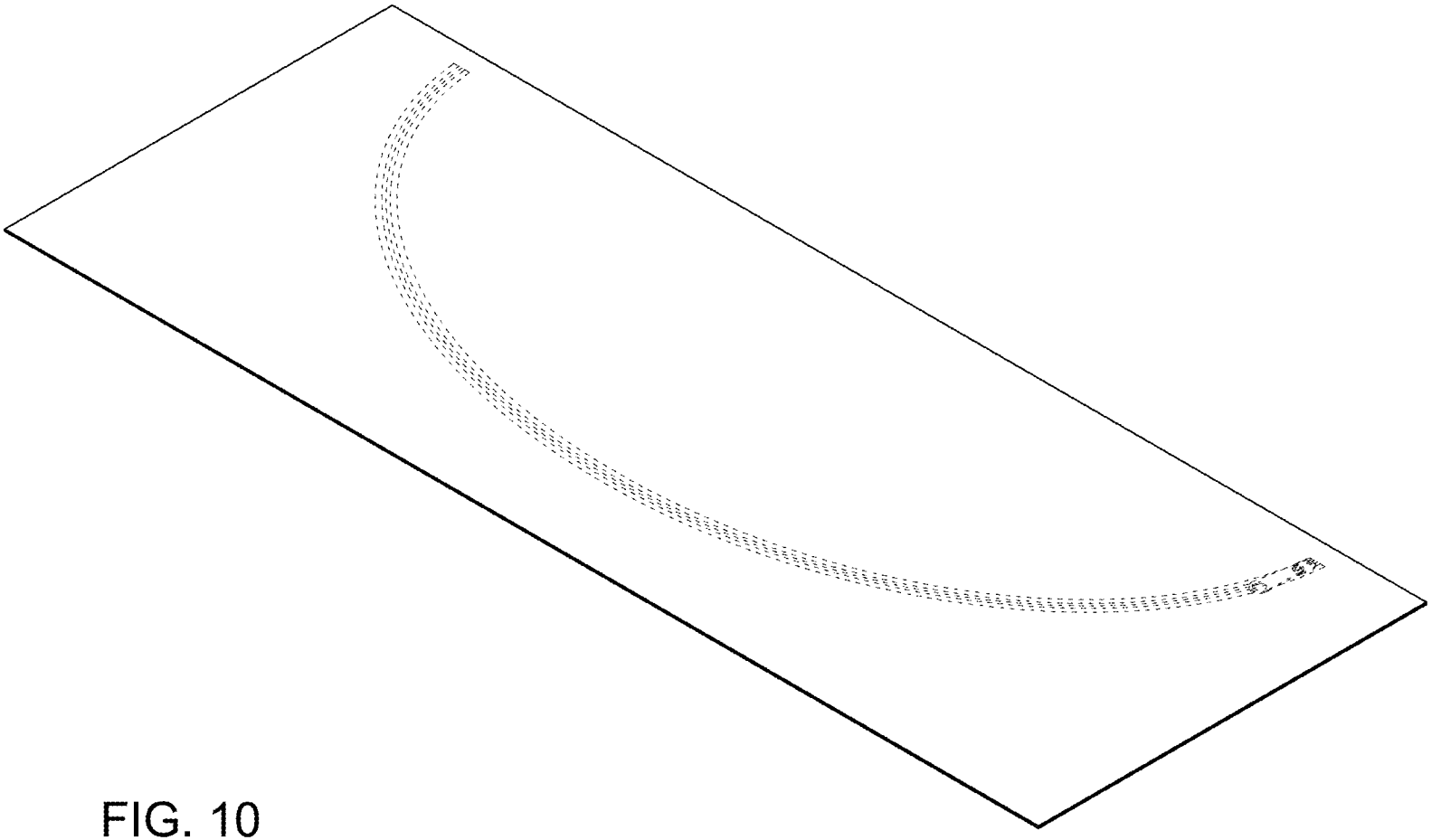
FIG. 10 is a top perspective view of a possible embodiment of the present body bag, the body bag being shown in a flattened and in a closed configuration.
Figure 11:
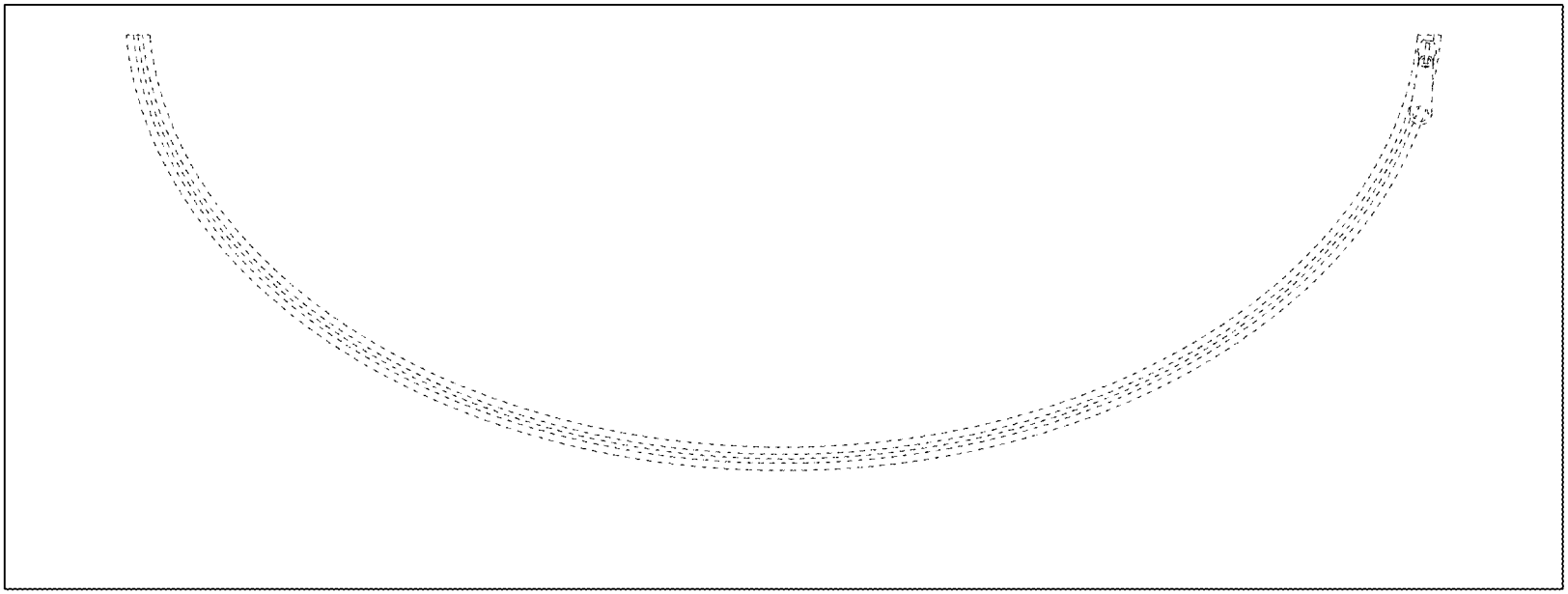
FIG. 11 is a top view of what is shown in FIG. 10.
Figure 12:
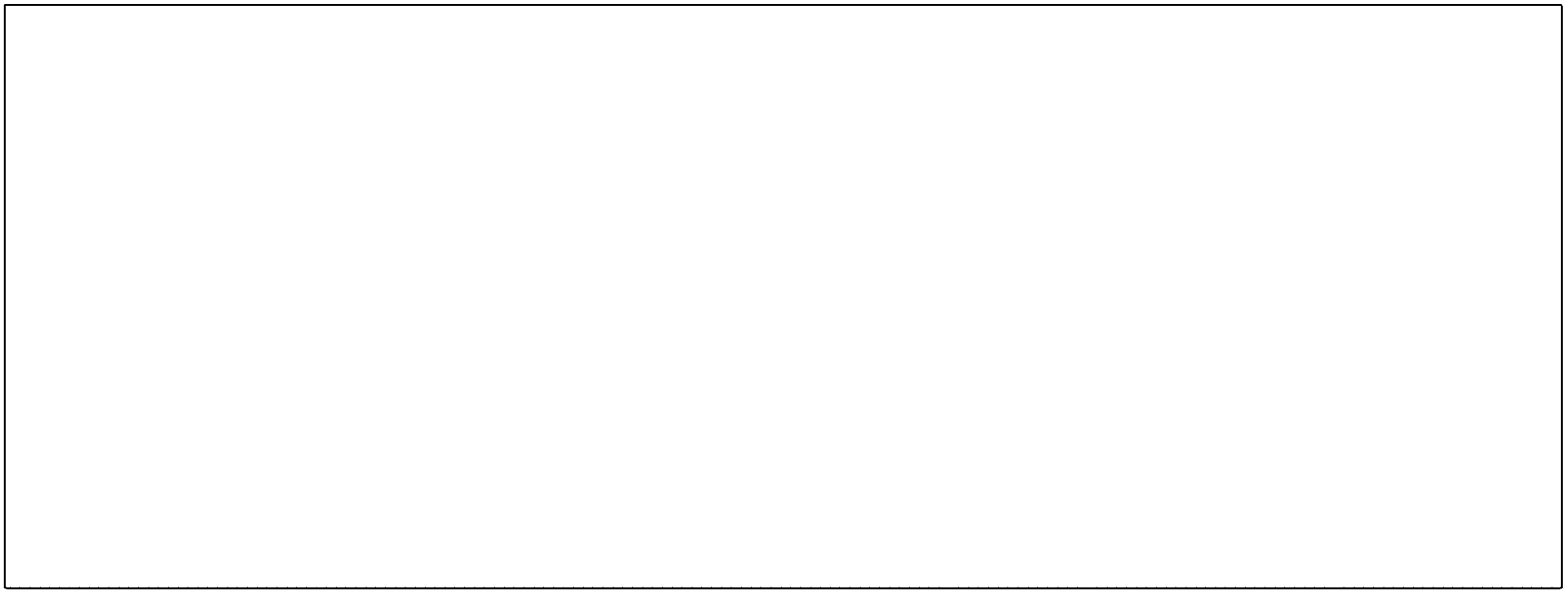
FIG. 12 is a bottom view of what is shown in FIG. 10.
Figure 17:
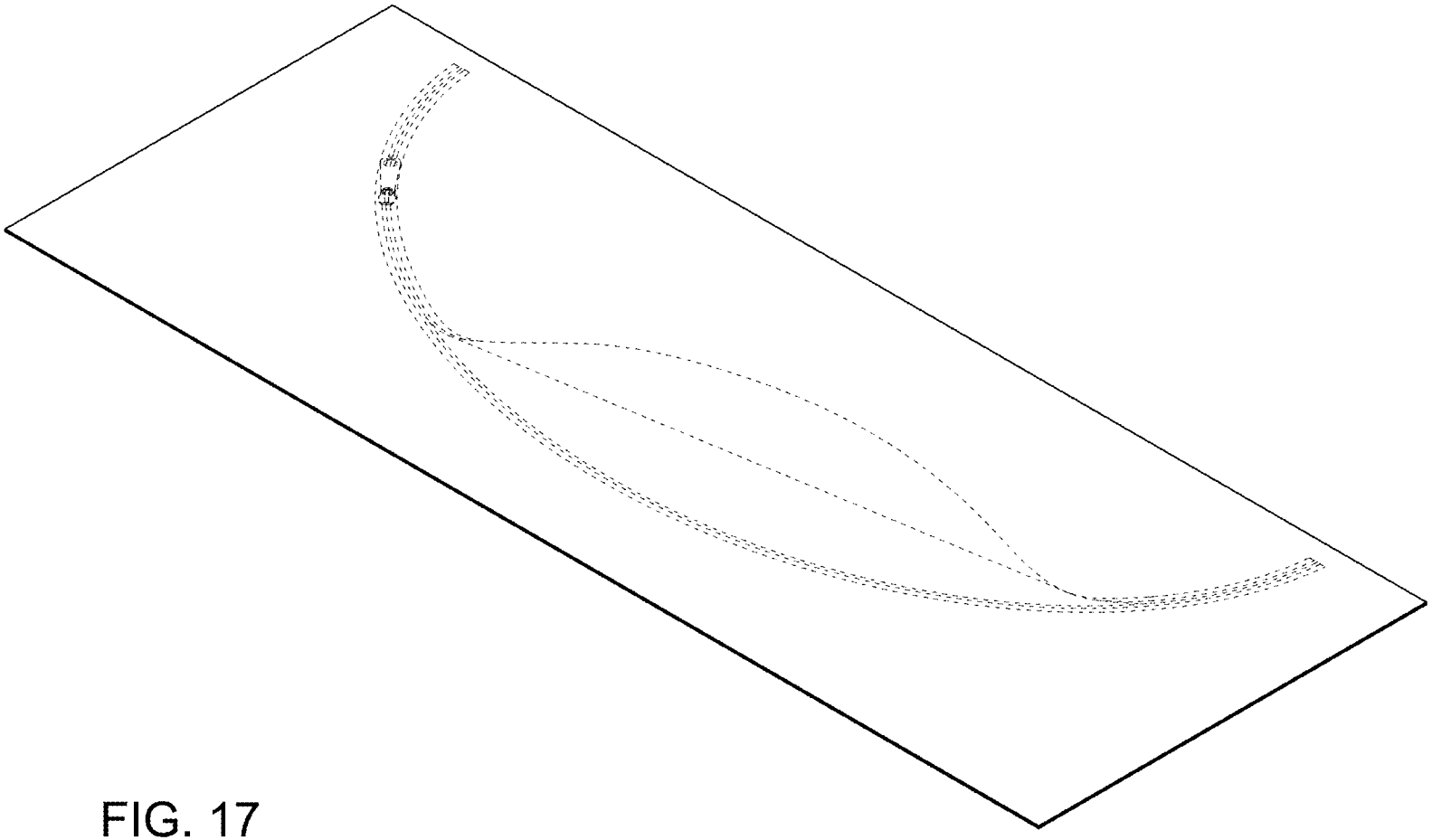
FIG. 17 is another top perspective view of what is shown in FIG. 10, the article being now shown in a partially-opened configuration.
Figure 18:
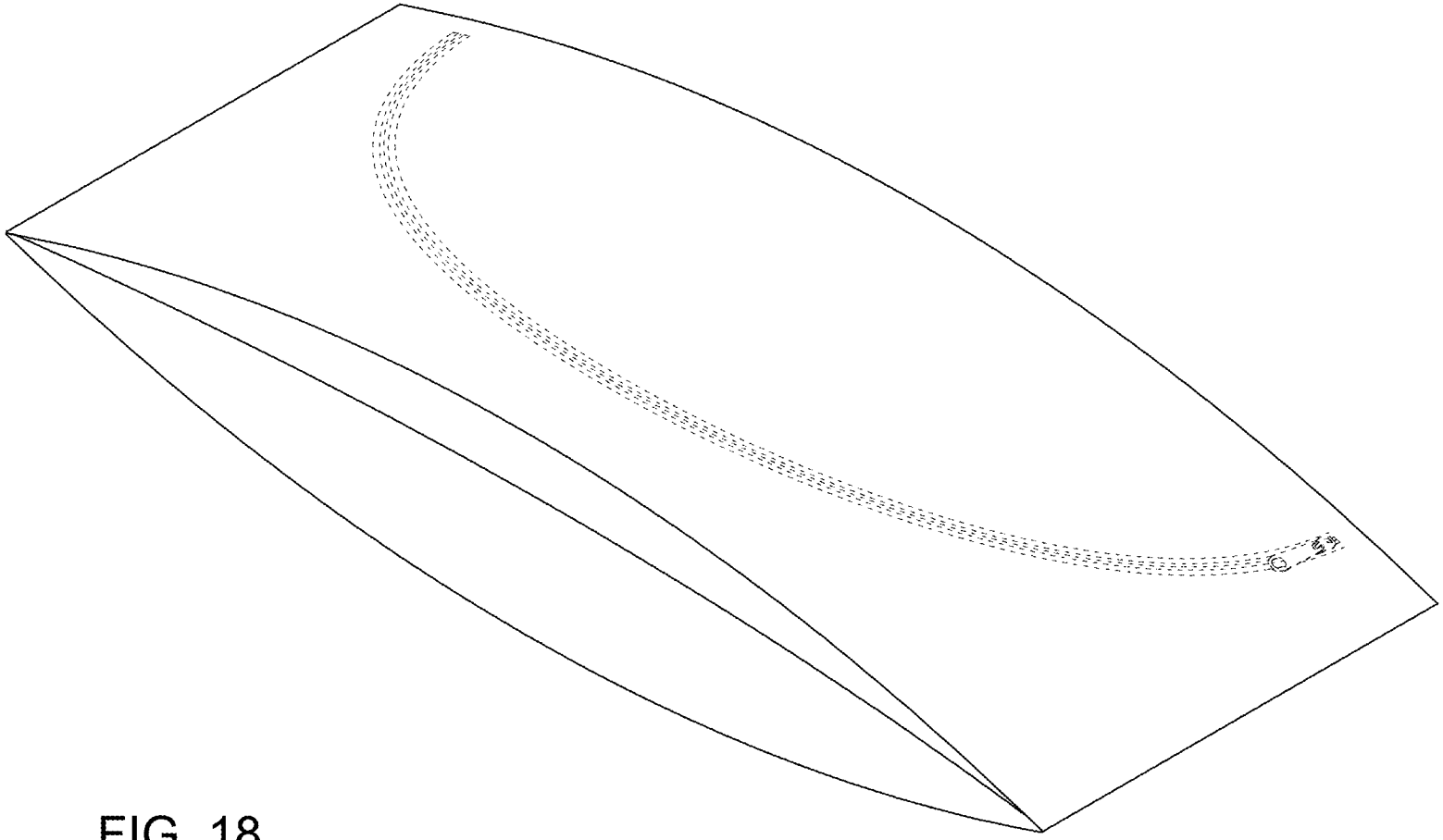
FIG. 18 is another top perspective view of what is shown in FIG. 10, the article being now shown in an expanded and in a closed configuration.
Figure 19:
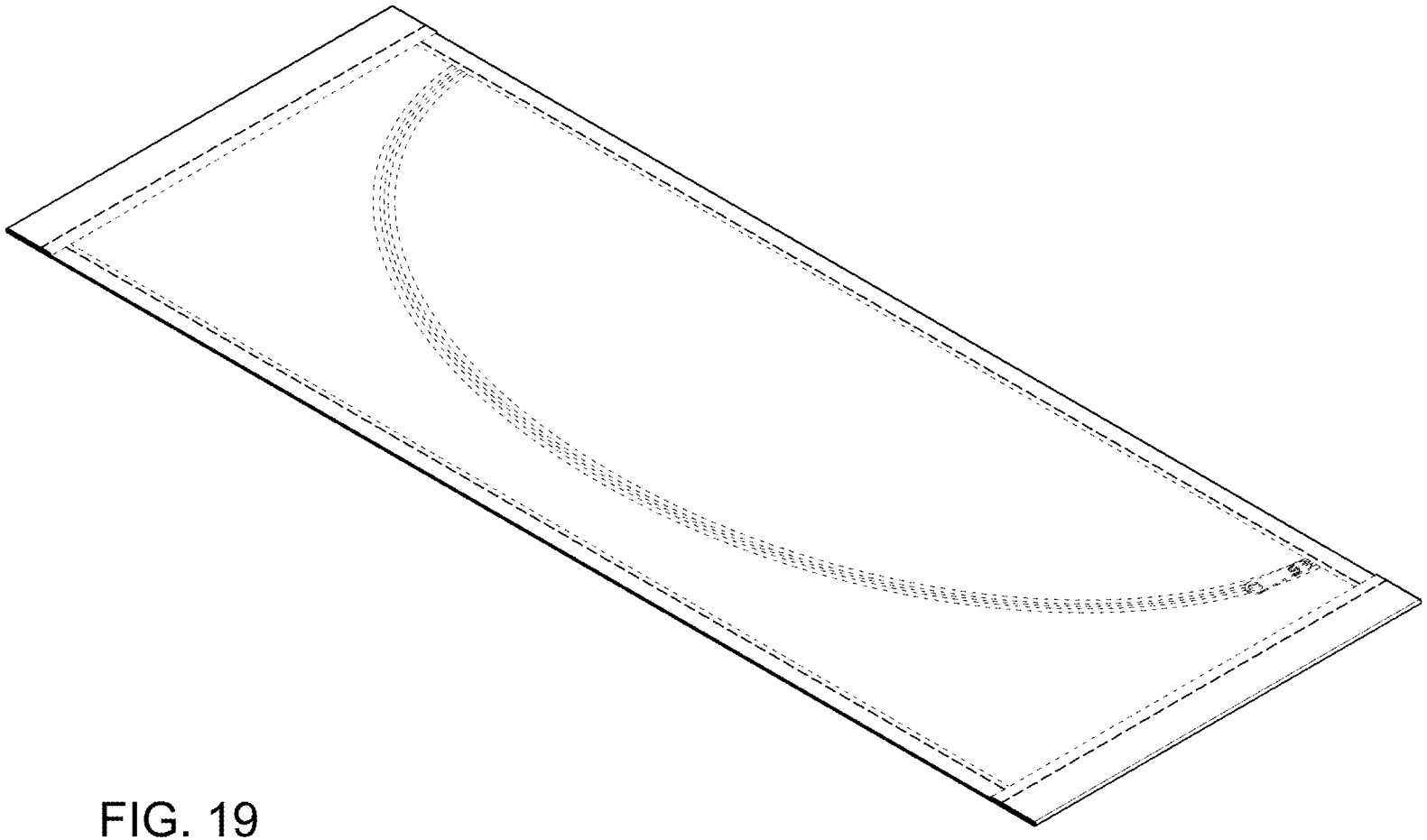
FIG. 19 is a top perspective view of another possible embodiment of the present body bag, the body bag being shown in a flattened and in a closed configuration.
Figure 20:
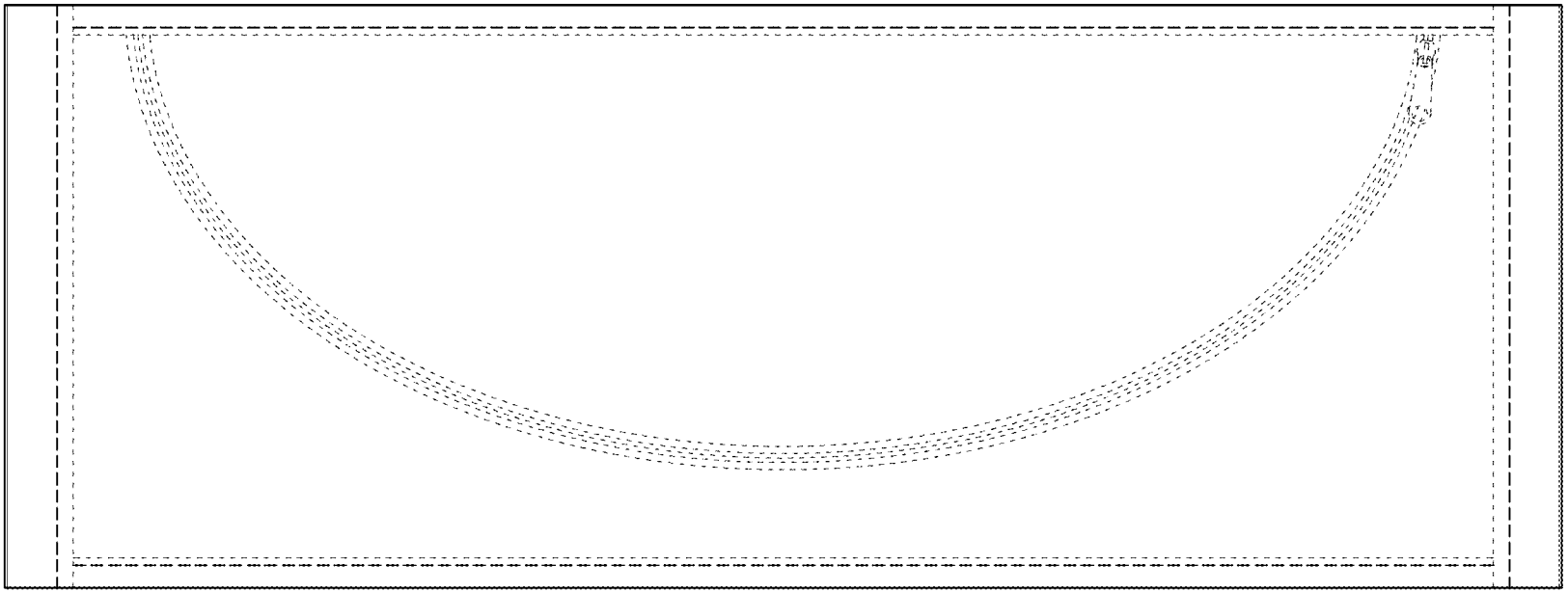
FIG. 20 is a top view of what is shown in FIG. 19.
Figure 21:
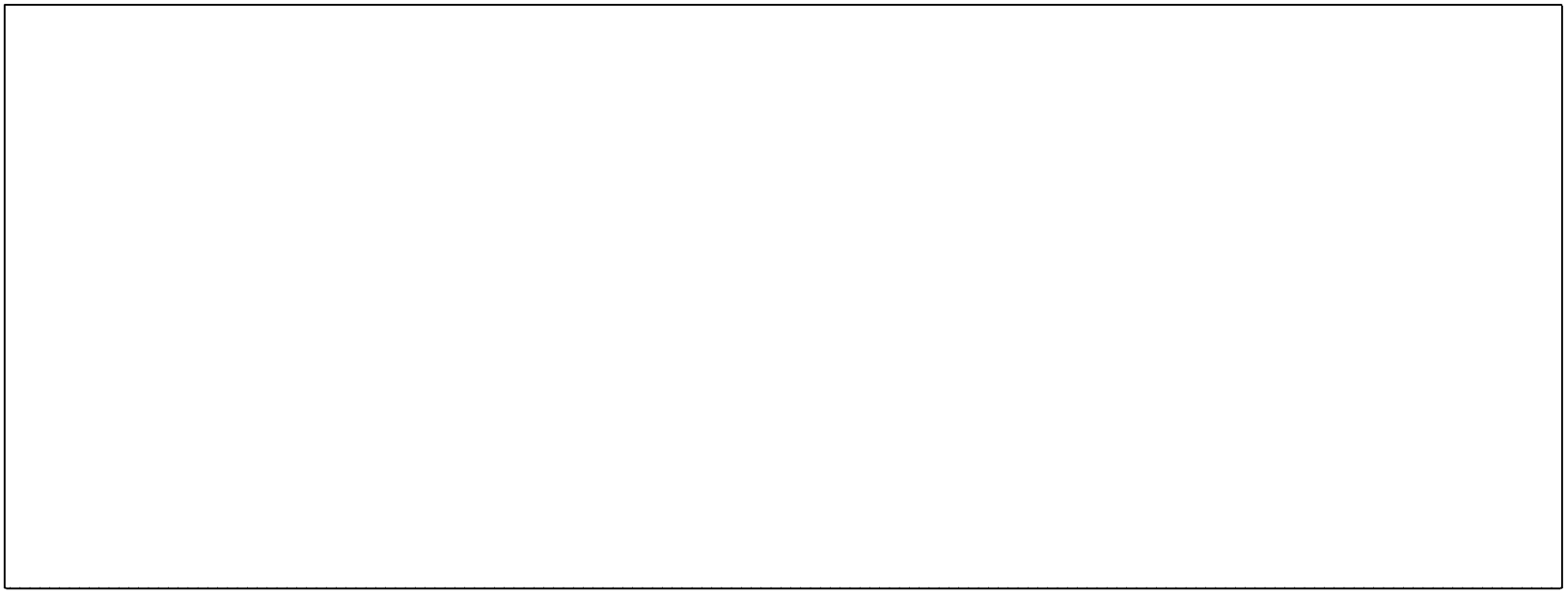
FIG. 21 is a bottom view of what is shown in FIG. 19.
Figures 24, 25:
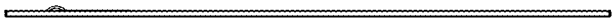
FIG. 24 is a right-side elevational view of what is shown in FIG. 19.
FIG. 25 is a left-side elevational view of what is shown in FIG. 19.
Figure 26:
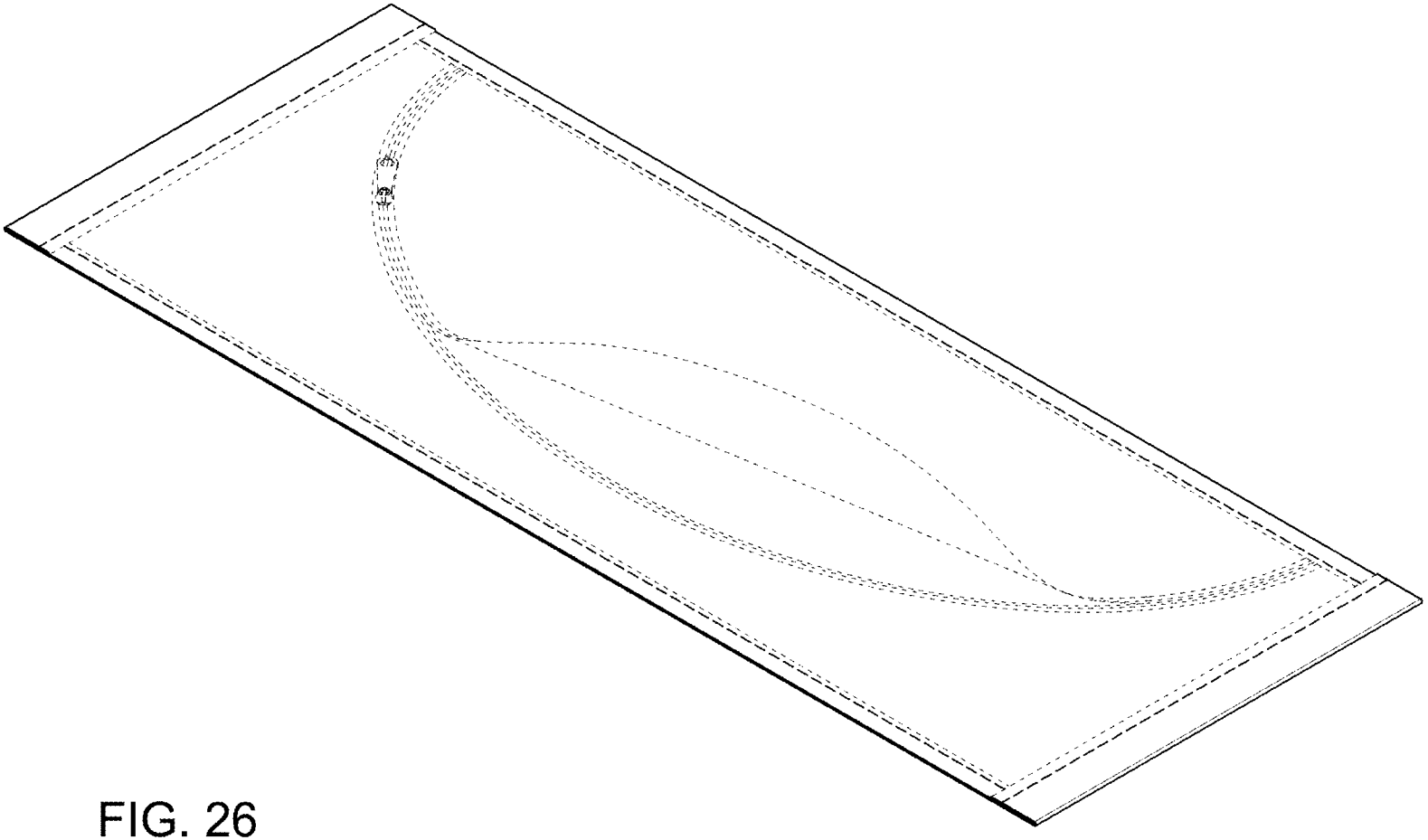
FIG. 26 is another top perspective view of what is shown in FIG. 19, the body bag being now shown in a partially-opened configuration.
Figure 27:
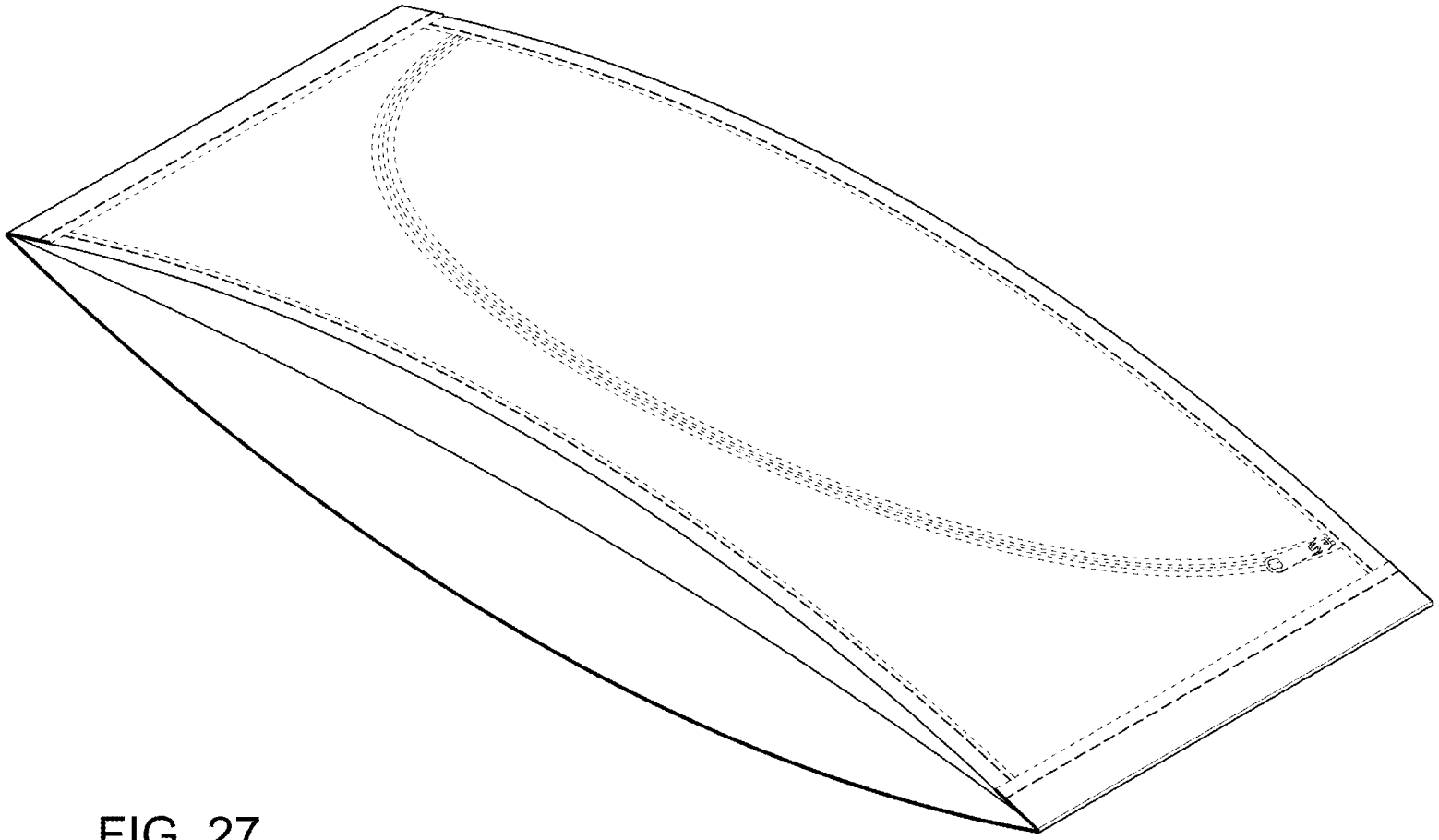
FIG. 27 is another top perspective view of what is shown in FIG. 19, the body bag being now shown in an expanded and in a closed configuration.
Figure 28:
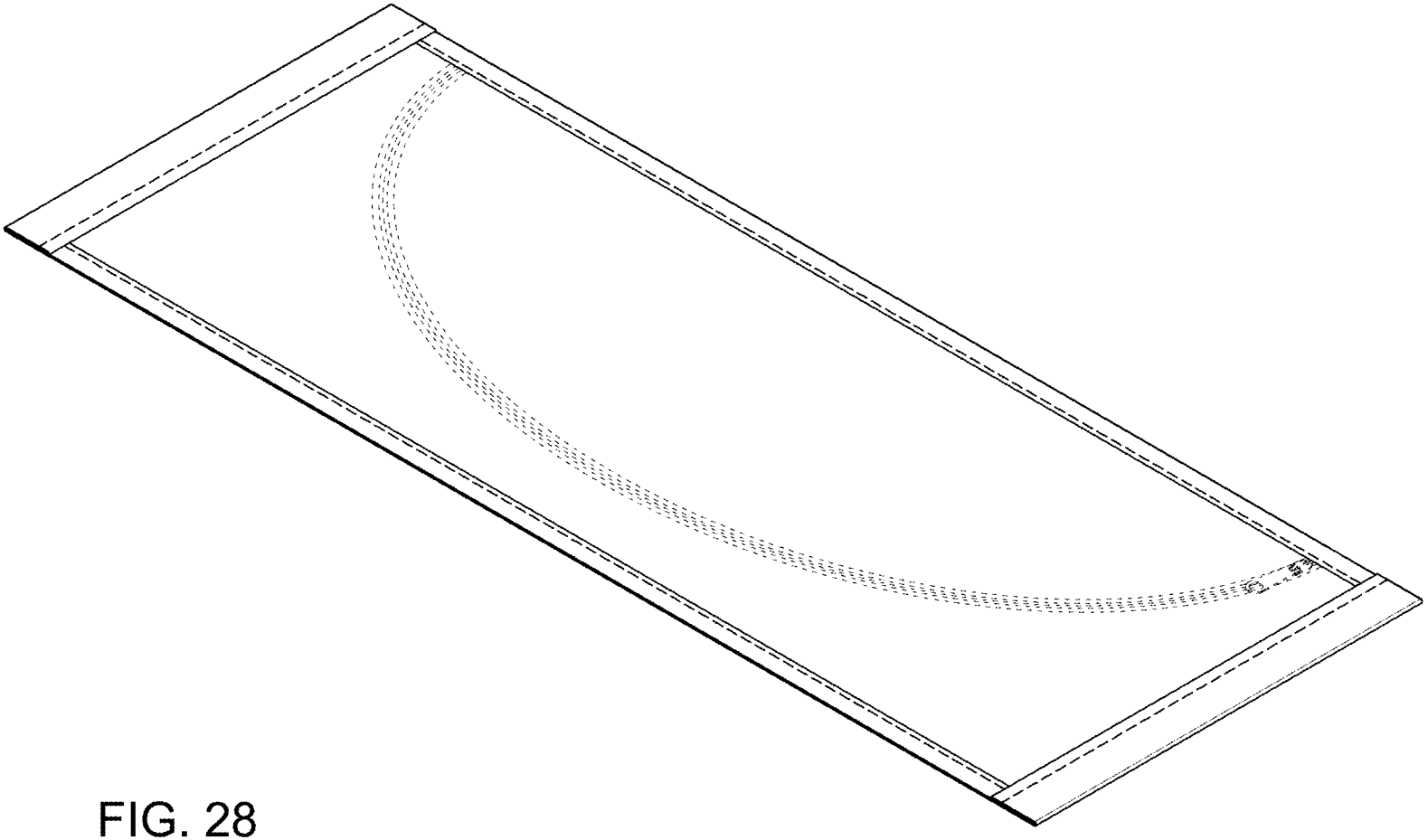
FIG. 28 is a top perspective view of another possible embodiment of the present body bag, the body bag being shown in a flattened and in a closed configuration.
Figure 29:
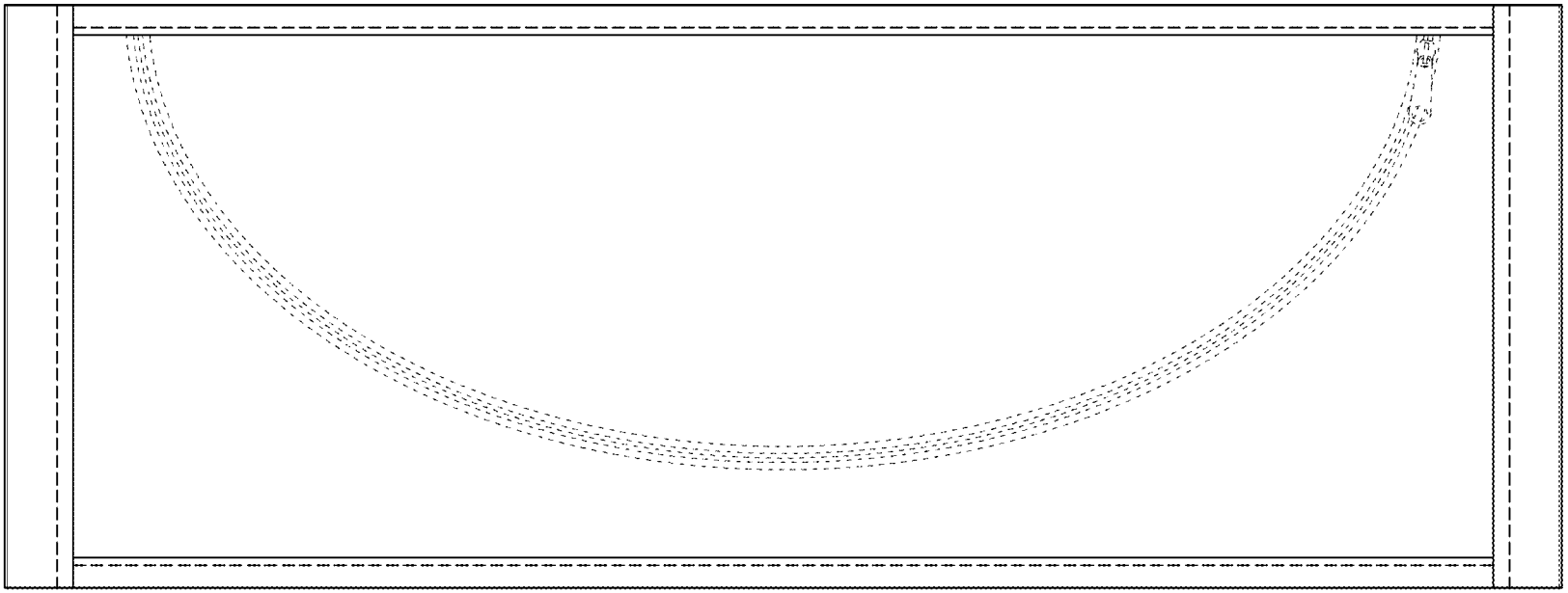
FIG. 29 is a top view of what is shown in FIG. 28.
Figure 30:
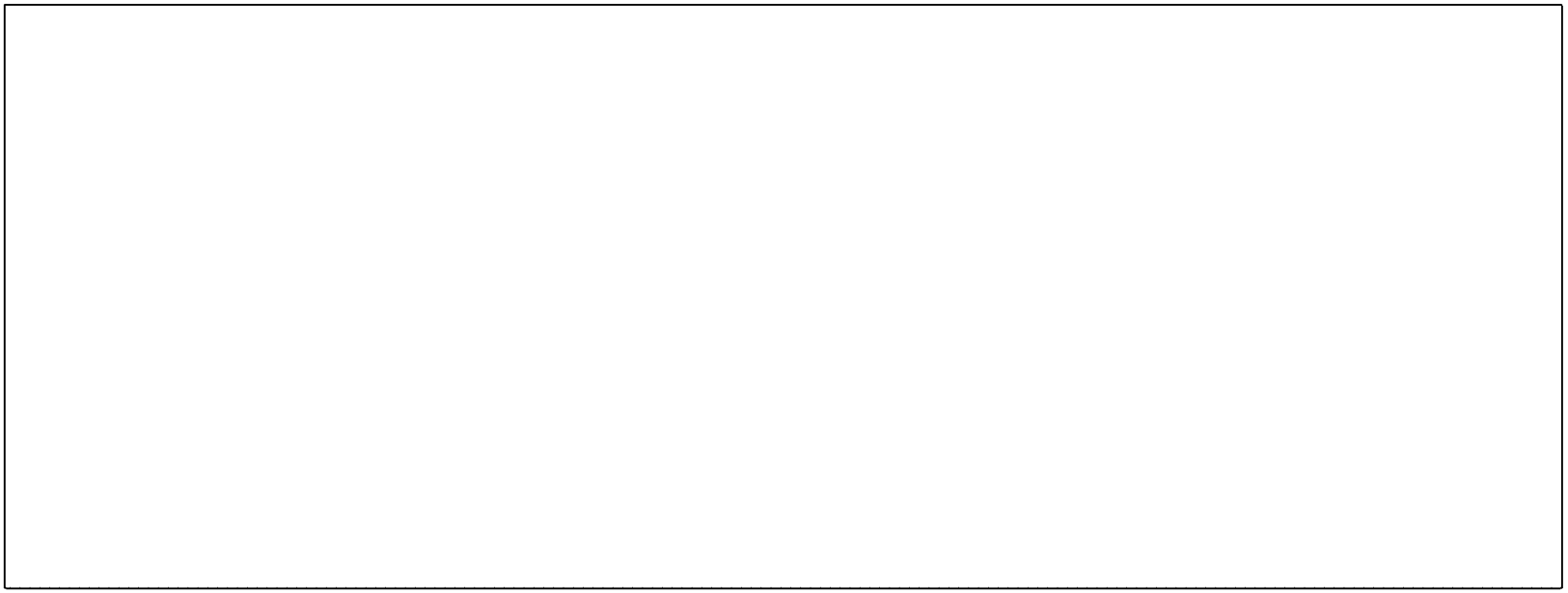
FIG. 30 is a bottom view of what is shown in FIG. 28.
Figures 33, 34:
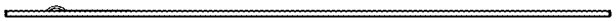
FIG. 33 is a right-side elevational view of what is shown in FIG. 28.
FIG. 34 is a left-side elevational view of what is shown in FIG. 28.
Figure 35:
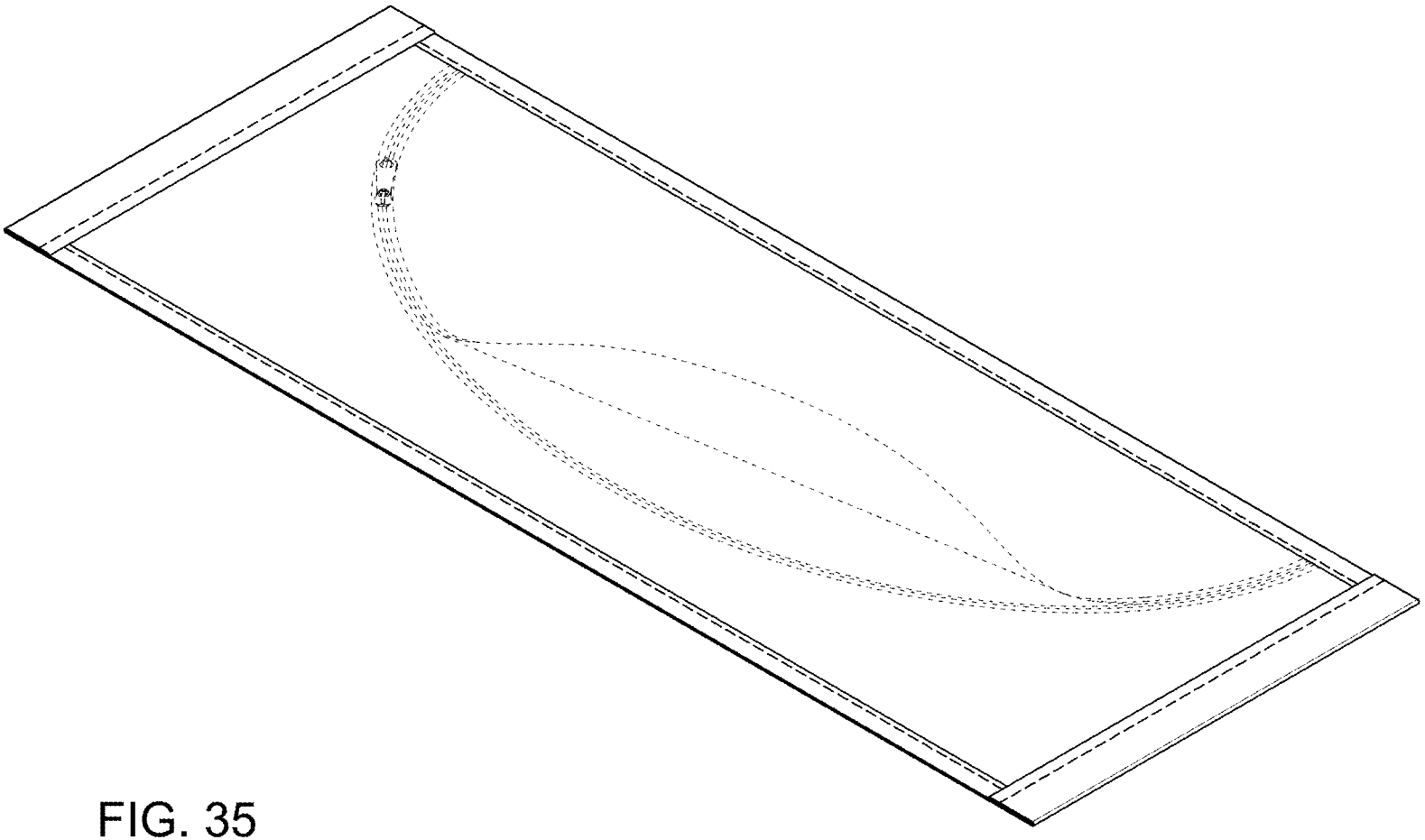
FIG. 35 is another top perspective view of what is shown in FIG. 28, the article being now shown in a partially-opened configuration.
Figure 36:
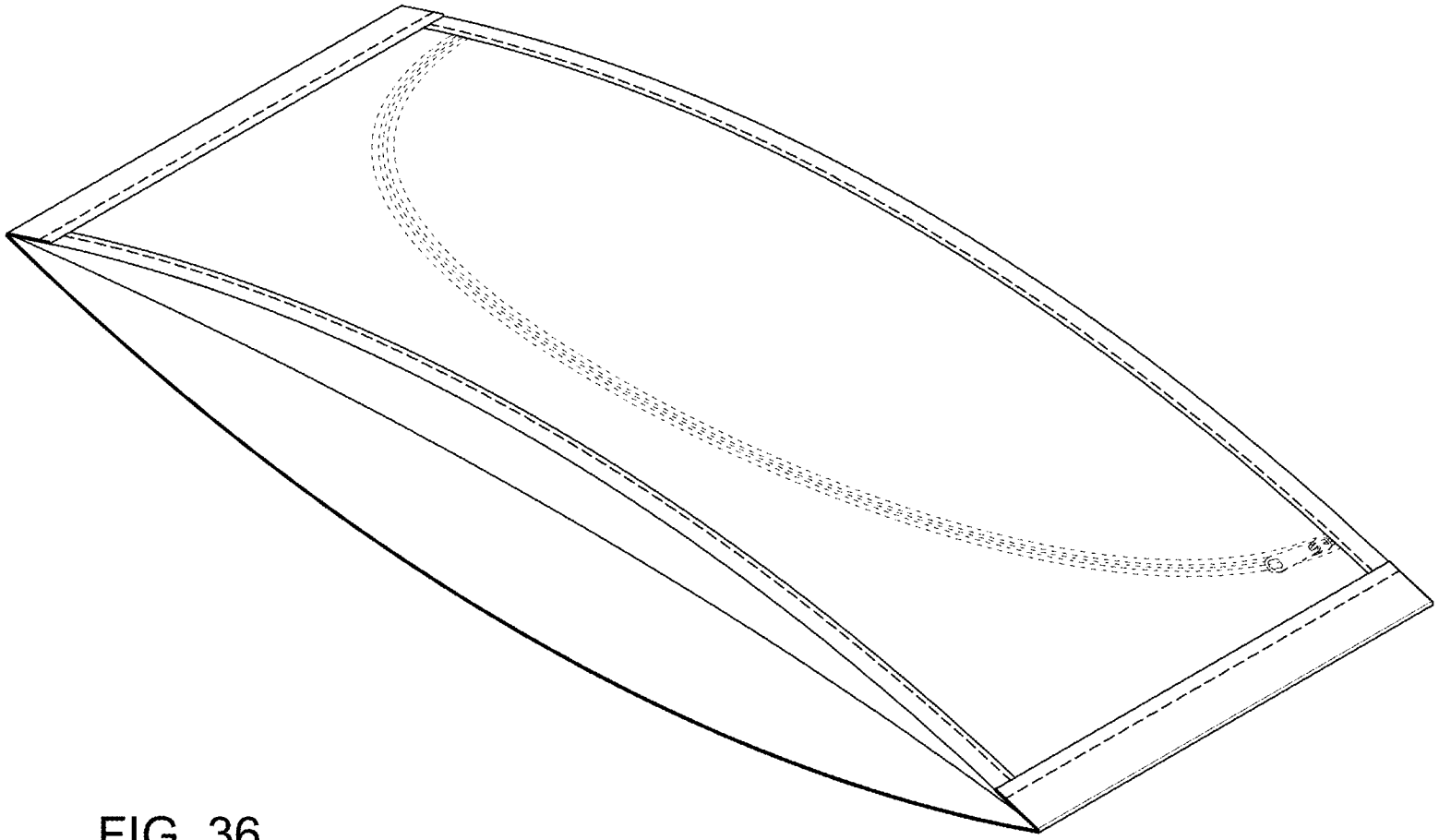
FIG. 36 is another top perspective view of what is shown in FIG. 28, the article being now shown in an expanded and in a closed configuration.

Now referring to FIG. 9 illustrating the body bag containing an example of a dead animal. The material used is such as not being able to identify the content of the body bag.

While illustrative and presently preferred embodiment(s) of the invention have been described in detail hereinabove, it is to be understood that the inventive concepts may be otherwise variously embodied and employed and that the appended claims are intended to be construed to include such variations except insofar as limited by the prior art.

The invention claimed is:

1. A body bag for containing a body, the body bag comprising:

a main containment body having top and bottom panels, the top panel including a closable flap being positioned, shaped and sized for allowing an insertion of the body into the main containment body of the body bag via said closable flap; and at least one expandable gusset operatively extendable between the top and bottom panels so as to allow the body bag to vary in size in accordance with the body being inserted into the main containment body;

at least one additional panel being separate from the top and bottom panels, and forming the at least one expandable gusset, the at least one expandable gusset comprising a pair of opposite expandable gussets disposed along corresponding opposite longitudinal sides of the body bag, and the top and bottom panels comprising opposite ends extending between the longitudinal sides of the body bag, the end of one of said top and bottom panels being foldable over and attachable onto the end of the other one of said top and bottom panels.

2. The body bag according to claim 1, wherein the end of the bottom panel is attached onto the top panel.

3. The body bag according to claim 1, wherein the end of the bottom panel is attached onto the top panel along a joint line using a sealing agent or an adhesive, defining a leakproof base.

4. The body bag according to claim 1, wherein the closable flap of the top panel has a substantially D-shaped configuration.

5. The body bag according to claim 1, wherein the closable flap is provided with a fastening device configured to selectively open and close said closable flap.

6. The body bag according to claim 5, wherein the fastening device is provided along a curved section of the closable flap.

7. The body bag according to claim 5, wherein the fastening device is provided with a locking mechanism to render the closable flap substantially leakproof.

8. The body bag according to claim 5, wherein the fastening device is configured to form a hermetic chamber within the body bag after the closable flap is closed.

9. The body bag according to claim 5, wherein the fastening device includes a hook-and-loop mechanism.

10. The body bag according to claim 1, wherein the body bag is provided with an identification area for an identification of the body inside the body bag.

11. The body bag according to claim 1, wherein the body bag is made from a single piece of material.

12. The body bag according to claim 1, wherein the body bag is made from a blank having different foldable sections corresponding to different panels of the body bag.

13. The body bag according to claim 1, wherein the body bag is made from a substantially waterproof material.

14. The body bag according to claim 1, wherein the body bag is made from a polymeric material selected from the group consisting of polyester, polypropylene, polyethylene, and/or any other suitable polymeric material.

15. The body bag according to claim 1, wherein the body bag is made from a material suitable for cremation.

16. The body bag according to claim 1, wherein the body bag is a veterinary bag used for the disposal of a dead animal.

17. A body bag for containing a body, the body bag comprising:

a main containment body having top and bottom panels, the top panel including a closable flap being positioned, shaped and sized for allowing an insertion of the body into the main containment body of the body bag via said closable flap; and at least one expandable gusset operatively extendable between the top and bottom panels so as to allow the body bag to vary in size in accordance with the body being inserted into the main containment body;

at least one additional panel being separate from the top and bottom panels, and forming the at least one expandable gusset, the at least one expandable gusset comprising a pair of opposite expandable gussets disposed along corresponding opposite longitudinal sides of the body bag, and the top and bottom panels comprising opposite ends extending between the longitudinal sides of the body bag, the end of one of said top and bottom panels being foldable over and attachable onto the end of the other one of said top and bottom panels;

wherein the closable flap is provided with a fastening device configured to selectively open and close said closable flap;

wherein the fastening device is provided with a locking mechanism to render the closable flap substantially leakproof; and wherein the body bag is made from a substantially waterproof material.

18. A body bag for containing a body, the body bag comprising:

a main containment body having top and bottom panels, the top panel including a closable flap being positioned, shaped and sized for allowing an insertion of the body into the main containment body of the body bag via said closable flap; and at least one expandable gusset operatively extendable between the top and bottom panels so as to allow the body bag to vary in size in accordance with the body being inserted into the main containment body, the top and bottom panels comprising opposite ends extending between the longitudinal sides of the body bag, the end of one of said top and bottom panels being foldable over and attachable onto the end of the other one of said top and bottom panels;

wherein the body bag comprises at least one additional panel being separate from the top and bottom panels, and forming the at least one expandable gusset;

wherein the at least one expandable gusset comprises a pair of opposite expandable gussets disposed along corresponding opposite longitudinal sides of the body bag;

wherein the end of the bottom panel is attached onto the top panel;

wherein the end of the bottom panel is attached onto the top panel along a joint line using a sealing agent or an adhesive, defining a leakproof base;

wherein the closable flap of the top panel has a substantially D-shaped configuration;

wherein the closable flap is provided with a fastening device configured to selectively open and close said closable flap;

wherein the fastening device is provided along a curved section of the closable flap;

wherein the fastening device is provided with a locking mechanism to render the closable flap substantially leakproof;

wherein the fastening device is configured to form a hermetic chamber within the body bag after the closable flap is closed; and wherein the body bag is provided with an identification area for an identification of the body inside the body bag.

* * * * *